US007492107B2

(12) United States Patent
Wang et al.

(10) Patent No.: US 7,492,107 B2
(45) Date of Patent: Feb. 17, 2009

(54) DEVICE FOR DRIVING LIGHT SOURCE MODULE

(75) Inventors: Chia-Peng Wang, Taipei Hsien (TW); Chih-Chan Ger, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 43 days.

(21) Appl. No.: 11/616,884

(22) Filed: Dec. 28, 2006

(65) Prior Publication Data

US 2008/0088255 A1 Apr. 17, 2008

(30) Foreign Application Priority Data

Oct. 11, 2006 (CN) ..... 200610063033.6

(51) Int. Cl.
*H05B 41/16* (2006.01)

(52) U.S. Cl. ..... 315/277; 315/247; 315/274; 315/307

(58) Field of Classification Search ..... 315/209 R, 315/224–225, 246–247, 276–277, 291, 307–308, 315/312, 274
See application file for complete search history.

(56) References Cited

U.S. PATENT DOCUMENTS

| | | | | |
|---|---|---|---|---|
| 5,907,223 | A | 5/1999 | Gu et al. | |
| 6,353,803 | B1 | 3/2002 | Degani | |
| 2003/0095147 | A1 | 5/2003 | Daw | |
| 2004/0064037 | A1 | 4/2004 | Smith | |
| 2004/0066153 | A1 * | 4/2004 | Nemirow et al. | 315/291 |
| 2004/0263092 | A1 * | 12/2004 | Liu | 315/247 |
| 2005/0105305 | A1 * | 5/2005 | Sawada et al. | 363/34 |
| 2005/0231130 | A1 * | 10/2005 | Chieh et al. | 315/247 |
| 2006/0152170 | A1 * | 7/2006 | Van Der Veen et al. | 315/274 |
| 2006/0175983 | A1 * | 8/2006 | Crouse et al. | 315/291 |
| 2007/0057642 | A1 * | 3/2007 | Pruett | 315/247 |

OTHER PUBLICATIONS

Lydia Ng et al., www.itk.org: Medical Visualization with ITK, pp. 1-25, no date.

Lennart Ljung, System Identification: Theory For The User, Text Book, ISBN No. 0-13-881640-9, 1987.

Berthold Klaus et al., Robot Vision—The MIT Electrical Engineering and Computer Science Series, Text Book—ISBN No. 0-262-08159-8 (MIT Press), 1986.

(Continued)

*Primary Examiner*—David Hung Vu
*Assistant Examiner*—Tung X Le
(74) *Attorney, Agent, or Firm*—Wei Te Chung

(57) ABSTRACT

A driving device for driving a light source module (47) includes a PFC circuit (42), a power stage circuit (44), an isolation transformer (T1), an inverter circuit (45) and a PWM controller (46). The PFC circuit converts a received AC signal to a DC signal. The power stage circuit is connected to the PFC circuit, for converting the DC signal to another AC signal. The isolation transformer has a primary winding and at least one secondary winding. The primary winding of the isolation transformer is connected to the power stage circuit, for isolating the received AC signal from the light source module. The inverter circuit is connected to the secondary winding of the isolation transformer, for converting an AC signal output from the isolation transformer to an appropriate signal. The PWM controller is connected to the power stage circuit, for controlling output from the power stage circuit.

10 Claims, 5 Drawing Sheets

OTHER PUBLICATIONS

Paul Tofts et al., Quantatative Analysis of Dynamic Gd-DTPA Enhancement in Breast Tumors Using a Permeability Model, pp. 564-568, 1995.

C.W. Piccoli, Contrast-enhanced breast MRI: factors affecting sensitivity and specificity, Eur. Radiol. 7 (Suppl. 5), pp. S281-S288, 1997.

Christopher J. C. Burgess, A Tutorial on Support Vector Machines for Pattern Recognition, Data Mining and Knowledge Discovery, 2, pp. 121-167, 1998.

S.C. Rankin, MRI of the breast, The British Journal of Radiology, Aug. 2000, pp. 806-818.

* cited by examiner

DEVICE FOR DRIVING LIGHT SOURCE MODULE

BACKGROUND OF THE INVENTION

1. Field of the Invention

The invention relates to driving devices for driving light source modules, and particularly to a driving device integrated with an AC/DC converter.

2. Description of Related Art

Conventionally, a liquid crystal display (LCD) panel uses discharge lamps, such as cold cathode fluorescent lamps (CCFLs), as light sources of a backlight system. Typically, an inverter converts a direct current (DC) signal output from an alternating current (AC)/DC converter to an AC signal to drive one or more light sources. The DC signal is normally from 5V to 24V.

Referring to FIG. 5, a block diagram of a conventional driving device is shown. The conventional driving device for driving a light source module 14 includes an AC power source 10, an AC/DC converter 11 and an inverter 12. The AC/DC converter 11 includes a power factor correction (PFC) circuit 110, a DC/AC converter circuit 111 and a transformer circuit 112. The inverter 12 includes a power stage circuit 120 and an inverter circuit 121.

The AC power source 10 outputs an AC signal that is transformed to a DC signal via the PFC circuit 110, and then the DC signal is converted to a square-wave signal via the DC/AC converter circuit 111. The square-wave signal is rectified and stepped down to another DC signal via the transformer circuit 112 and a peripheral rectify circuit in the transformer circuit 112. The inverter 12 converts the received DC signal to a sine-wave signal, and provides it to the light source module 14.

In the conventional driving device, the AC signal output from the AC power source is converted to the sine-wave signal via DC signal, square wave signal, DC signal and square wave signal, which has lower conversion efficiency, such as: about 70%. In addition, the conventional driving device has a higher cost, and occupied a larger area.

SUMMARY OF THE INVENTION

An exemplary embodiment of the invention provides a driving device for driving a light source module, which includes a PFC circuit, a power stage circuit, an isolation transformer, an inverter circuit and a PWM controller. The PFC circuit converts a received AC signal to a DC signal. The power stage circuit is connected to the PFC circuit, for converting the DC signal to another AC signal. The isolation transformer has a primary winding and at least one secondary winding. The primary winding of the isolation transformer is connected to the power stage circuit, for isolating the received AC signal from the light source module. The inverter circuit is connected to the secondary winding of the isolation transformer, for converting an AC signal output from the isolation transformer to an appropriate signal. The PWM controller is connected to the power stage circuit, for controlling output from the power stage circuit.

Another exemplary embodiment of the invention provides a driving device for driving a light source module, which includes a PFC circuit, a power stage circuit, an isolation transformer and an inverter circuit. The PFC circuit converts a received AC signal to a DC signal. The power stage circuit is connected to the PFC circuit, for converting the DC signal to another AC signal. The isolation transformer has a primary winding and at least one secondary winding. The primary winding of the isolation transformer is connected to the power stage circuit, for isolating the received AC signal from the light source module. The inverter circuit is connected to the secondary winding of the isolation transformer, for converting an AC signal output from the isolation transformer to an appropriate signal. The inverter circuit includes a plurality of transformers. Each of the transformers has at least one primary winding and secondary winding. High terminals of the primary windings of the transformers are jointly connected to a high terminal of the secondary winding of the isolation transformer, low terminals of the primary windings of the transformers are jointly connected to a low terminal of the secondary winding of the isolation transformer, high terminals of the secondary windings of the transformers are correspondingly connected to a lamp.

Other advantages and novel features will become more apparent from the following detailed description of preferred embodiments when taken in conjunction with the accompanying drawings, in which:

DETAILED DESCRIPTION OF THE INVENTION

Figure 1:
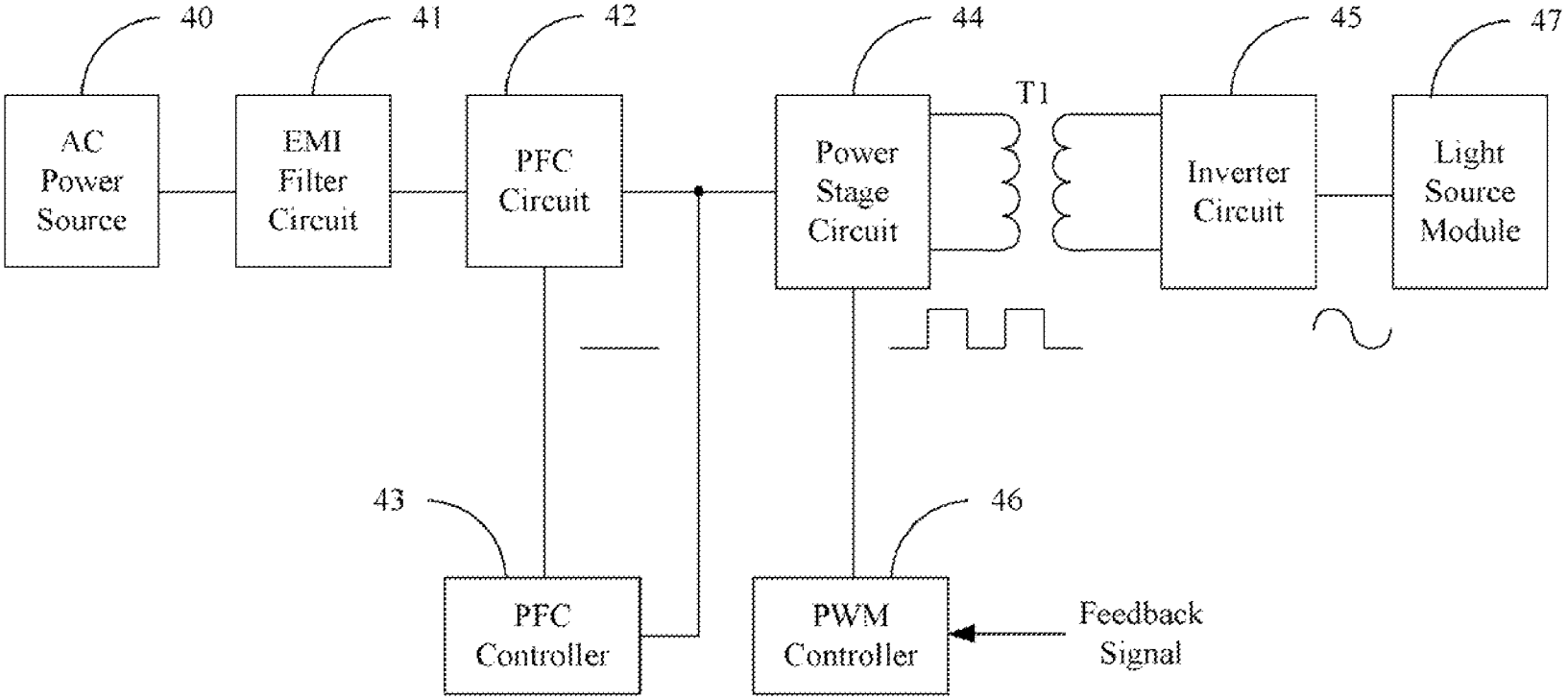
FIG. 1 is a block diagram of a driving device of an exemplary embodiment of the present invention.

FIG. 1 is a block diagram of a driving device of an exemplary embodiment of the present invention. The driving device for driving a light source module 47 includes an alternating current (AC) power source 40, an electro-magnetic interference (EMI) filter circuit 41, a power factor correction (PFC) circuit 42, a PFC controller 43, a power stage circuit 44, an isolation transformer T1, an inverter circuit 45, and a pulse-width modulation (PWM) controller 46. In the exemplary embodiment, the light source module 47 includes a plurality of lamps.

The AC power source 40 provides an AC signal. The AC signal is transmitted to the PFC circuit 42 via the EMI filter circuit 41. The EMI filter circuit 41 is connected between the AC power source 40 and PFC circuit 42, for filtering EMI signals of the AC signal output from the AC power source 40. In the exemplary embodiment, the PFC circuit 42 is a booster circuit, for converting the AC signal to a DC signal and boosting the DC signal. In the exemplary embodiment, the boosted DC signal is about 400V.

In the exemplary embodiment, the PFC controller 43 is connected to the PFC circuit 42, for stabilizing the DC signal output from the PFC circuit 42.

The power stage circuit 44 is connected to the PFC circuit 42, for converting the DC signal output from the PFC circuit 42 to another AC signal. In the exemplary embodiment, the AC signal output from the power stage circuit 44 is a square-wave signal, and the power stage circuit 44 can be a full-bridge circuit, a half-bridge circuit, a push-pull circuit, or a royer circuit.

The isolation transformer T1 includes a primary winding and a secondary winding. The primary winding is connected to the power stage circuit 44, and the secondary winding is connected to the inverter circuit 45. In alternative embodiments, the isolation transformer T1 can include a plurality of secondary windings. Normally, according to security standard, power of the AC signal output from the AC power source 40 is very risk, which can not be connected directly to a light source module 47. In order to protect the light source module 47 and the inverter circuit 45, the driving device uses the isolation transformer T1 to isolate the light source module 47 and the inverter circuit 45 from the AC power source 40. In the exemplary embodiment, the AC signal output from the power stage circuit 44 can be stepped down via the isolation transformer T1.

The inverter circuit 45 converts the AC signal output from the isolation transformer T1 to an appropriate AC signal to drive the light source module 47. In the exemplary embodiment, the AC signal output from the inverter circuit 45 is a sine-wave signal.

The PWM controller 46 is connected to the power stage circuit 44, for controlling the AC signal output from the power stage circuit 44 according to a received feedback signal. In the exemplary embodiment, the feedback signal includes a current signal, a voltage signal, a temperature signal, and so on. The current signal indicates current flowing through the light source module 47, which is sensed by a current feedback circuit. The voltage signal and temperature signal indicate voltage and temperature of the light source module 47, which are sensed by a sensing circuit and fed back to the PWM controller 46. Therefore, the PWM controller 46 can detect whether the current, the voltage or the temperature of the light source module 47 are normal, and then controls the output of the power stage circuit 44.

Figure 2:
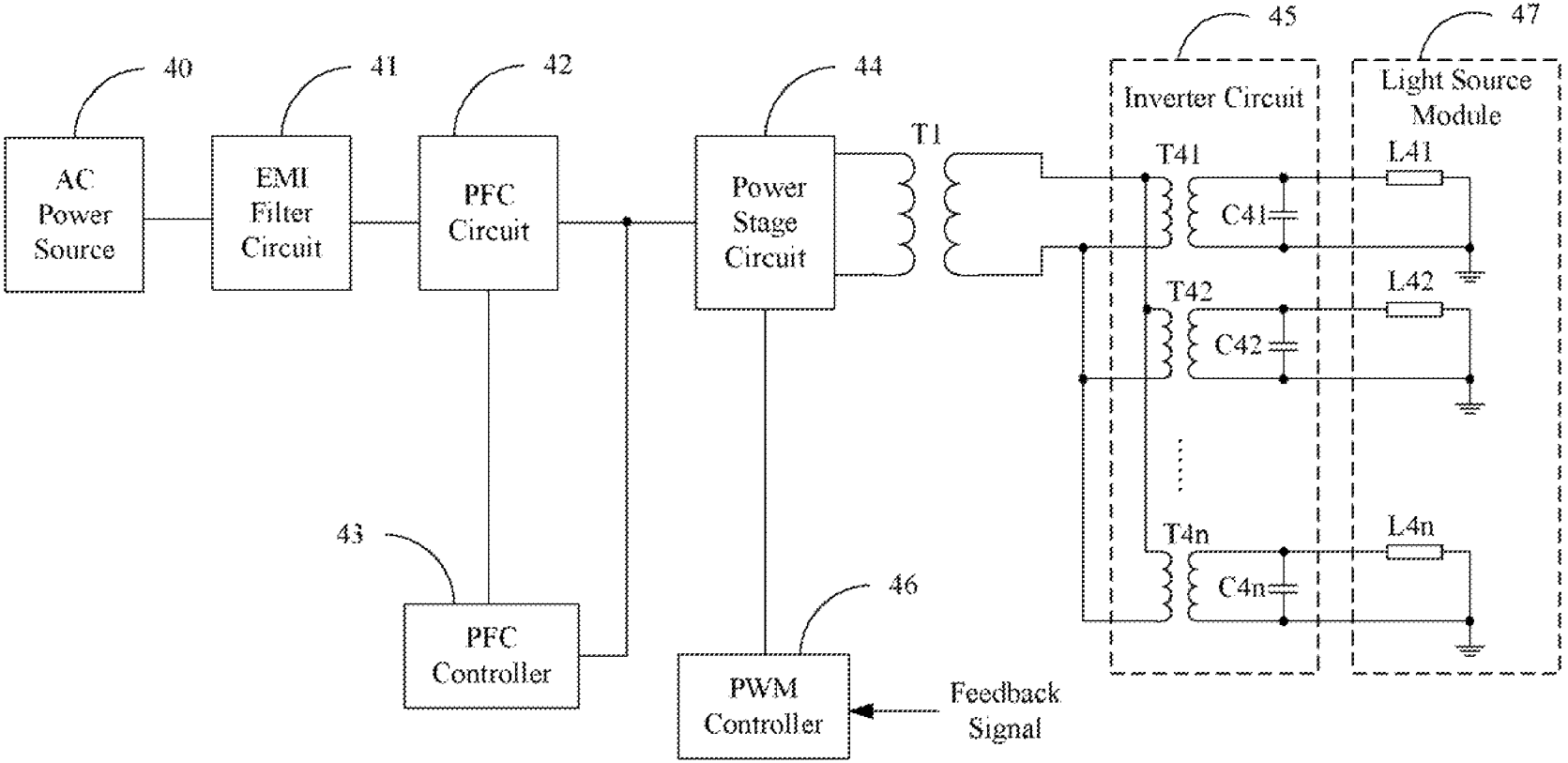
FIG. 2 is a detailed circuit of FIG. 1.

FIG. 2 is a detailed circuit of FIG. 1 of the present invention. The inverter circuit 45 includes a plurality of transformers T4*n* (n=1, 2, 3, . . . , n) and a plurality of capacitors C4*n* (n=1, 2, 3, . . . , n). The light source module 47 includes a plurality of lamps L4*n* (n=1, 2, 3, . . . , n). Each of the transformers T4*n* (n=1, 2, 3, . . . , n) includes a primary winding and a secondary winding. In the exemplary embodiment, high terminals of the primary windings of the transformers T4*n* (n=1, 2, 3, . . . , n) are jointly connected to a high terminal of the secondary winding of the isolation transformer T1, and low terminals of the primary windings of the transformers T4*n* (n=1, 2, 3, . . . , n) are jointly connected to a low terminal of the secondary winding of the isolation transformer T1. High terminals of the secondary windings of the transformers T4*n* (n=1, 2, 3, . . . , n) are respectively connected to one end of a lamp, and low terminals of the secondary windings of the transformers T4*n* (n=1, 2, 3, . . . , n) are grounded. The other end of the lamps L4*n* (n=1, 2, 3, . . . , n) are grounded.

Each of the capacitors C4*n* (n=1, 2, 3, . . . , n) is connected between the high terminal and low terminal of the secondary winding of the corresponding transformer T4*n* (n=1, 2, 3, . . . , n), which form a resonance circuit with a leakage inductance of the secondary winding of the corresponding transformer T4*n* (n=1, 2, 3, . . . , n), and thus converting the AC signal to the appropriate AC signal to drive the light source module 47. In alternative embodiments, parasitic capacitances of the lamps L4*n* (n=1, 2, 3, . . . , n), can replace the capacitors C4*n* (n=1, 2, 3, . . . , n) and also form a resonance circuit with the leakage inductance of the secondary winding of the corresponding transformer T4*n* (n=1, 2, 3, . . . , n). In addition, connections of the capacitors C4*n* (n=1, 2, 3, . . . , n) and the isolation transformer T1 may be formed by other known methods, which are not limited to the present invention. In alternative embodiments, the transformers T4*n* (n=1, 2, 3, . . . , n) also have a plurality of primary windings.

Figure 3:
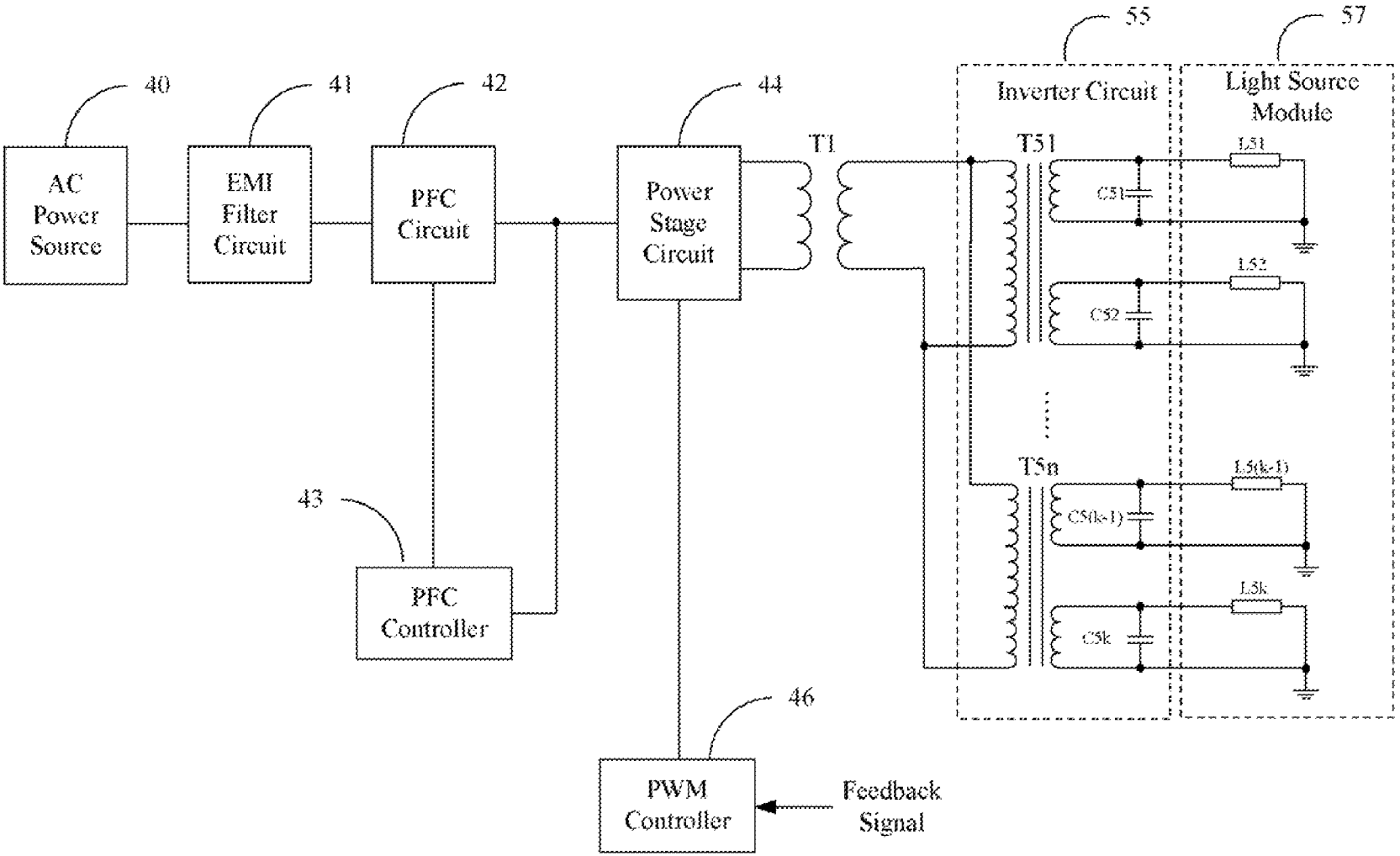
FIG. 3 is another detailed circuit of FIG. 1.

FIG. 3 is another detailed circuit of FIG. 2 of the present invention. The inverter circuit 55 includes a plurality of transformers T5*n* (n=1, 2, 3, . . . , n) and capacitors C5*k* (k=1, 2, 3, . . . , k). The light source module 57 includes a plurality of lamps L5*k* (k=1, 2, 3, . . . , k). In the exemplary embodiment, k is equal to 2n. Each of the transformers T5*n* (n=1, 2, 3, . . . , n) includes a primary winding, a first secondary winding and a second secondary winding. High terminals of the primary windings of the transformers T5*n* (n=1, 2, 3, . . . , n) are jointly connected to a high terminal of the secondary winding of the isolation transformer T1. Low terminals of the primary windings of the transformers T5*n* (n=1, 2, 3, . . . , n) are jointly connected to a low terminal of the secondary winding of the isolation transformer T1. In each of the transformers T5*n* (n=1, 2, 3, . . . , n), high terminals of the first and second secondary windings are respectively connected to one end of a lamp, and the low terminals of the first and second secondary windings are grounded. In addition, the other ends of the lamps L5*k* (k=1, 2, 3, . . . , k) are also grounded. Each of the capacitors C5*k* (k=1, 2, 3, . . . , k) is connected between the high terminal and the low terminal of the first secondary winding of the corresponding transformer T5*n* (n=1, 2, 3, . . . , n), and is connected between the high terminal and the low terminal of the second secondary winding of the corresponding transformer T5*n* (n=1, 2, 3, . . . , n). Therefore, a resonance circuit is formed by the corresponding capacitor C5*k* (k=1, 2, 3, . . . , 2n) and the leakage inductance of the first and the second secondary windings of the transformers T5*n* (n=1, 2, 3, . . . , n), and thus converting the AC signal to an appropriate AC signal to drive the light source module 57. In alternative embodiments, the transformers T5*n* (n=1, 2, 3, . . . , n) also include a plurality of primary windings.

Figure 4:
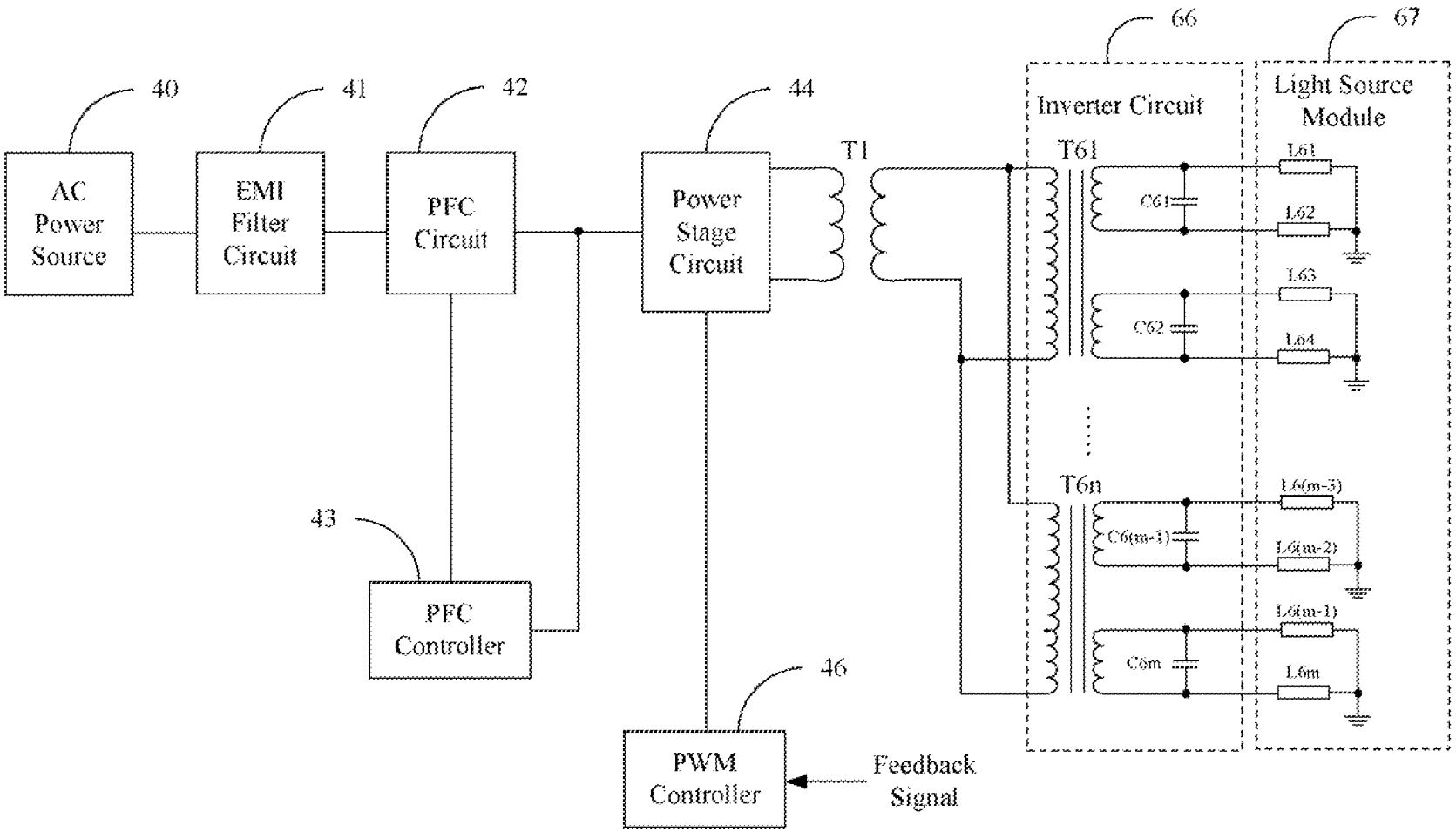
FIG. 4 is another detailed circuit of FIG. 1.
Figure 5:
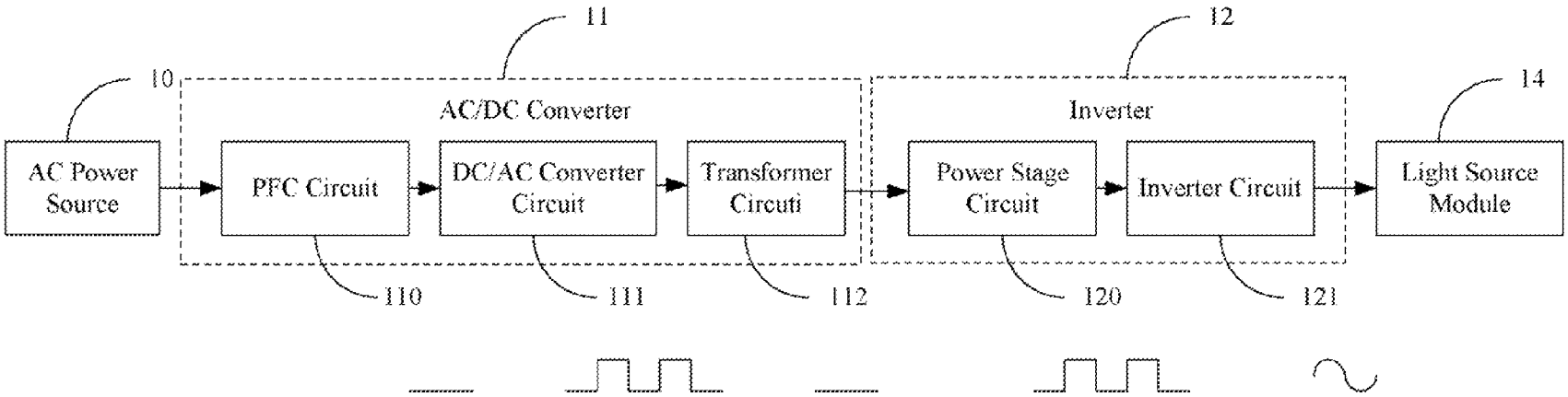
FIG. 5 (Related Art)
FIG. 5 is a block diagram of another conventional driving device.

FIG. 4 is another detailed circuit of FIG. 1 of the present invention, which is substantially the same as that of FIG. 3, except that in FIG. 4, the light source module 67 includes a plurality of lamps L6*m* (m=1, 2, 3, . . . , m), and a high terminal and a low terminal of a first and a second secondary windings of each of the transformers T6*n* (n=1, 2, 3, . . . , n) are respectively connected to a lamp. In the exemplary embodiment, m is equal to 4n.

In the present invention, a driving device directly transmits an AC signal output from an isolation transformer to an inverter circuit, which omits a rectifying circuit and a DC/AC converter circuit of the conventional driving device. Therefore, a conversion efficiency of the driving device of the present invention is about 85%. In addition, the driving device has lower cost and is smaller.

While embodiments and methods of the present invention have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A driving device for driving a light source module comprising a plurality of lamps, comprising:

a power factor correction (PFC) circuit for converting a received alternating current (AC) signal to a direct current (DC) signal;

a power stage circuit connected to the PFC circuit, for converting the DC signal to another AC signal;

an isolation transformer having a primary winding and at least a secondary winding; wherein the primary winding of the isolation transformer is connected to the power stage circuit, for isolating the received AC signal from the light source module;

an inverter circuit, connected to the secondary winding of the isolation transformer, for converting an AC signal output from the isolation transformer to an appropriate signal to drive the light source module; and a PWM controller, connected to the power stage circuit, for controlling output from the power stage circuit;

wherein the inverter circuit comprises:

a plurality of transformers; wherein each of the transformers has at least a primary winding, a first secondary winding and a second secondary winding; and a plurality of capacitors, correspondingly connected between high and low terminals of the first secondary windings of the transformers, and connected between high and low terminals of the second secondary windings of the transformers;

wherein high terminals of the primary windings of the transformers are jointly connected to a high terminal of the secondary winding of the isolation transformer, low terminals of the primary windings of the transformers are jointly connected to a low terminal of the secondary winding of the isolation transformer, high terminals of the first and the second secondary windings of the transformers are respectively connected to a lamp, and low terminals of the first and the second secondary windings of the transformers are grounded.

2. The driving device as claimed in claim 1, further comprising an AC power source, for providing the AC signal received by the PFC circuit.

3. The driving device as claimed in claim 2, further comprising an electro-magnetic interference (EMI) filter circuit, connected between the AC power source and the PFC circuit, for filtering EMI signals of the AC signal output from the AC power source.

4. The driving device as claimed in claim 1, wherein the PWM controller receives a feedback signal.

5. The driving device as claimed in claim 1, further comprising a PFC controller connected to the PFC circuit, for stabilizing output from the PFC circuit.

6. A driving device for driving a light source module comprising a plurality of lamps, comprising:

a power factor correction (PFC) circuit for converting a received alternating current (AC) signal to a direct current (DC) signal;

a power stage circuit, connected to the PFC circuit, for converting the DC signal to another AC signal;

an isolation transformer having a primary winding and at least a secondary winding; wherein the primary winding of the isolation transformer is connected to the power stage circuit, for isolating the received AC signal from the light source module; and an inverter circuit, connected to the secondary winding of the isolation transformer, for converting an AC signal output from the isolation transformer to an appropriate signal to drive the light source module, wherein the inverter circuit comprises:

a plurality of transformers; wherein each of the transformers has at least a primary winding and a secondary winding;

wherein high terminals of the primary windings of the transformers are jointly connected to a high terminal of the secondary winding of the isolation transformer, low terminals of the primary windings of the transformers are jointly connected to a low terminal of the secondary winding of the isolation transformer, high terminals of the secondary windings of the transformers are respectively connected to a lamp;

wherein the low terminals of the secondary windings of the transformers are respectively connected to another lamp.

7. The driving device as claimed in claim 6, further comprising a plurality of capacitors, correspondingly connected between high and low terminals of the secondary windings of the transformers.

8. The driving device as claimed in claim 6, further comprising a PWM controller, connected to the power stage circuit, for controlling output from the power stage circuit.

9. The driving device as claimed in claim 8, wherein the PWM controller receives a feedback signal.

10. The driving device as claimed in claim 6, further comprising a PFC controller connected to the PFC circuit, for stabilizing output from the PFC circuit.

* * * * *